United States Patent [19]

Vrancken et al.

[11] 4,004,924

[45] Jan. 25, 1977

[54] THERMORECORDING

[75] Inventors: Marcel Nicolas Vrancken, Hove, Belgium; Wolfgang Lässig, Cologne-Stammheim, Germany

[73] Assignee: AGFA-GEVAERT N.V., Mortsel, Belgium

[22] Filed: June 17, 1975

[21] Appl. No.: 587,642

Related U.S. Application Data

[60] Continuation of Ser. No. 405,780, Oct. 12, 1973, abandoned, which is a division of Ser. No. 550,834, May 17, 1966, Pat. No. 3,793,025.

[30] Foreign Application Priority Data

May 17, 1965 United Kingdom ..... 20818/65
May 24, 1965 United Kingdom ..... 21985/65

[52] U.S. Cl. ..... 96/35; 96/28
[51] Int. Cl.[2] ..... G03C 5/00; G03C 11/12
[58] Field of Search ..... 96/27, 36, 2, 11, 28, 96/29, 30, 31, 33, 36.2–36.4, 47, 35; 427/146, 150; 250/317, 425

[56] References Cited

UNITED STATES PATENTS 3,476,937 11/1969 Vrancken ..... 250/65

*Primary Examiner*—Mary F. Kelley
*Attorney, Agent, or Firm*—William J. Daniel

[57] ABSTRACT

A process for reproducing an original having visible light absorptive image markings on a light transparent background by exposing to visible light passing through the original a normally water-removable heat-sensitive recording layer which consists essentially of a hydrophilic water-removable binder having generally homogeneously distributed therethrough finely divided particles of a hydrophobic thermoplastic polymer normally solid at room temperature together with finely divided material capable of absorbing visible light and converting it into heat and is otherwise generally transparent. The exposure is for a time lasting no longer than $10^{-1}$ second to visible light of an intensity of at least 0.3 watt, sec. per sq.cm. and sufficient to heat the areas of the layer corresponding to the transparent background areas of the original to reduce the water removability thereof but not sufficient to heat the areas of the layer corresponding to the image areas of the original to reduce the water removability thereof. The exposed layer is washed with an aqueous liquid to remove the areas corresponding to the image areas.

14 Claims, 13 Drawing Figures

THERMORECORDING

This application is a continuation of Ser. No. 405,780, filed Oct. 12, 1973, now Abandoned, which is a division of Ser. No. 550,834, filed May 17, 1966, now U.S. Pat. No. 3,793,025.

The present invention relates to a method for recording respectively reproducing information by means of electromagnetic radiation and a heat-sensitive material comprising at least one heat-sensitive element and substances wherein heat is produced by exposure to electromagnetic radiation.

In Belgian Patent Specification 656,713 it is disclosed that a heat-sensitive recording material comprising at least one sheet or layer containing thermoplastic polymer particles with or without continuous binder medium differing from said particles in permeability and/or lyophobicity can be used for recording a heat pattern as a permeable-impermeable and/or lyophilic-lyophobic differentiation.

More particularly the recording method according to said Belgian Patent Specification comprises the steps of record-wise subjecting to the action of heat a recording material comprising at least one layer or sheet having incorporated therein particles composed wholly or mainly of a hydrophobic thermoplastic polymer, said layer or sheet either entirely or substantially entirely consisting of said particles or wholly or mainly consisting of a dispersion of said particles in a hydrophilic binder in a ratio greater than 1:1 by weight.

It is an object of the present invention to provide a method for recording a pattern of electromagnetic radiation in terms of a differentiation in permeability and/or lyophility and/or solubility and/or meltability.

It is more particularly an object of the present invention to provide a method for recording a pattern of visible light in terms of a differentiation in permeability and/or lyophility and/or solubility and/or meltability.

It is a further object of the present invention to provide different embodiments for producing printing masters, such as a screen-printing master, a planographic printing master, a letterpress or gravure master, a magnetic printing master, a hydrotype master and a hectographic printing master.

Yet another object of the present invention is to produce a visible copy of an original, which may be a transparency or an opaque original having light-reflecting areas by means of recording materials and exposure techniques described herein.

These and other objects as well as advantager of this invention will appear hereinafter and are illustrated by means of drawings, which, however, should not be considered as a restriction thereof.

It has been found that these objects can be accomplished by a method for recording respectively reproducing information which method comprises record-wise or information-wise exposing to electromagnetic radiation a recording material, which comprises at least one recording layer (which may be carried by a support or may be a self-supporting layer or sheet) incorporating one or more hydrophobic thermoplastic polymers in the form of particles, and wherein said layer is prepared starting from an aqueous dispersion of said thermoplastic polymer particles, and said particles in said material are in heat-conducting relationship with one or more substances, which absorb electromagnetic radiation in at least a part of the wavelength range of said radiation and convert the corresponding part of said radiation into heat, the exposure being of high intensity and short duration so that an image or record is formed in or an said layer in terms of a difference in permeability, and/or lyophility and/or solubility and/or meltability.

Although the heat-sensitive layer for use according to the present invention need not contain a binder it preferably contains a hydrophilic binder but in a ratio smaller than 1:1 by weight in respect of the thermoplastic particles. Best results are obtained with a recording layer containing one or more hydrophobic thermoplastic polymers in the form of particles dispersed in a hydrophilic binder in a ratio of 3:2 by weight According to a preferred embodiment the exposures is carried out by means of electromagnetic radiation the greater part of which (at least 70% of the irradiation energy) is composed of electromagnetic radiation within a wavelength range beneath 700 nm. According to the present invention the exposure is preferably carried out by means of visible light.

The short duration exposure of the recording layer preferably does not exceed $10^{-1}$ second, and according to a preferred practice the exposure of one and the same area of the recording layer takes less than $10^{-2}$ second and is preferably in a period of time comprised between $10^{-2}$ and $10^{-4}$ second.

The process according to the present invention depends for its result on a selective or differential heating of the recording layer so that a property of the said layer, e.g. its meltability, water-permeability, solubility in water or an organic solvent, and/or hydrophility becomes selectively or differentially modified.

The image differentistion is obtained by the heat produced in the said substances absorbing electromagnetic radiation. In order to transfer or conduct that heat to the thermoplastic polymer particles of the recording layer said substances have to stand in heat-conducting relationship therewith and therefore are preferably present in the recording layer itself, although they may be present in another material or member located in intimate contact therewith.

The principle of recording according to the present invention can be readily appreciated from a single example, vis. a recording layer composed of hydrophobic thermoplastic polymeric material in the form of particles applied from an aqueous dispersion whether or not containing a certain amount of hydrophilic binder so that the layer is water-permeable in view of the presence of intersticies between the said particles. If light-absorbing substances are present in the recording layer and are in heat-conducting or heat-exchanging relationship with the polymer particles, and the system is exposed for a very brief time to a pattern of high-intensity electromagnetic radiation, heat is generated in the area wherein the substances absorbing electromagnetic radiation are intensely irradiated and the temperature of the parts of the recording layer being in the immediate proximity of said substances is suddenly raised. As a result of said heating the physical properties (meltability, hydrophility, permeability, solubility) of said layer are very selectively changed.

From the foregoing it appears that the polymer particles must be present in a significant proportion in the recording layer.

The record in terms of hydrophility and/or permeability and/or solubility and/or meltability can be used in many different ways as will be illustrated hereafter.

These various modes of use include processing steps for making the record visible.

In its preferred form the recording process according to the present invention can be defined in the steps of 1. providing a recording material, comprising at least one substantially dry and water-permeable layer containing particles composed wholly or mainly of a hydrophobic thermoplastic polymer dispersed in a hydrophilic binder in a ratio greater than 1:1 by weight, said particles preferably softening between 10° and 200° C above room temperature an sizing preferably of from 0.01 $\mu$ to 50 $\mu$and being in heat-conducting relationship with one or more substances which absorb visible light in the whole visible spectrum or in a part thereof and convert it into heat;

2. record-wise flash-exposing the recording material to electromagnetic radiation containing a substantial amount of visible light so that the recording material undergoes a selective or differential decrease in permeability and/or lyophility and/or solubility and/or meltability according to the light radiation record.

When referring to selective or differential decrease in permeability and/or lyophility and/or solubility and/or meltability according to the radiation record we mean that the achieved permeability or lyophility and/or solubility and/or meltability pattern constitutes a detectable record of the visible radiation pattern conveying the information to be recorded.

By record-wise of information-wise exposing to electromagnetic radiation is meant that the exposure may be progressive (in the dense that the exposure of a recording tape to spoken information to progressive) or simultaneous, e.g. as is the case of reflectographic or transmission exposure respectively to or through an original, e.g. a printed text or silver image transparency. When assuming, for example, that the information to be recorded is in the form of written or printed matter, the record in terms of differential lyophobicity and/or permeability and/or solubility and/or meltability may be legible or laterally reversed and may be developable as a record that is positive or negative with respect to the original.

From the statements that the differentiaation constituting the record may be in terms of the degree of permeability and/or lyophobicity and/or solubility, and/or meltability, it will be understood that it is unnecessary for the recording sheet or layer, which is image-wise or record-wise heated according to the method of the present invention, to exhibit some areas that are completely impermeable and/or lyophobic and/or insoluble and/or unmeltable and some areas that are completely permeable and/or lyophilic, and/or soluble and/or meltable.

The particular degree and/or kind of kinds of differentiation necessary in any given case will depend upon the intended use of the differentiation record, in other words, on the manner in which this record is to be read or developed. As will be apparent from the following description, the invention can be applied in a considerable variety of recording and copying techniques including, e.g., photographic recording and photographic and/or mechanical copying methods.

The process according to the invention is suitable for the preparation of prints by the reflex copying method or by usual transmission printing i.e. direct exposure, e.g. in contact. When applying a reflex copying method, the intensity of exposure and the heat-sensitivity of the recordig layer are chosen in such a way, that on the absorption of the light rays directed to the original and striking undifferentially the light-sensitive layer, the heating resulting therefrom causes practically no or only a slight loss of permeability and/or of lyophility and/or solubility and/or meltability of the heat-sensitive layer.

The additional image-wise heat resulting from the image-wise reflected light produces in the recording material the practical useful image differentiation between the areas struck by reflected light and those which are not struck thereby.

For reflex exposure the layer or layers of the recording material should obviously be sufficiently transparent. When applying the transmission printing process the recording material or any constituted layer thereof, if it comprises more than one layer, may be opaque.

The notion "transparent" pertains to the printing light used, which in the case of a gas discharge exposure device substantially consists of light with wavelengths ranging from 0.3 $\mu$ to 1 $\mu$. According to the type of light source producing visible light a more or less great amount of infrared radiation and ultra-violet radiation can be present in the recording light.

For the conversion of visible light into heat finely divided black or dark coloured pigments or dyes are preferably worked up into the heat-sensitive layer and may be worked up in another layer or object adjacent thereto, provided a sufficient heat conduting relationship between said substances and the thermoplastic polymer particles will exist.

As to the mechanism of recording it is assumed without the intention of restricting the invention hereby, that the finely divided hydrophobic thermoplastic polymer particle, which are surrounded by a hydration layer or by means of a wetting agent are dispersed in a hydrophilic binder can enter into intimate contact with one another due to the locally very intense and sudden heating, thereby forming substantially impermeable polymer film or net-work of hydrophobic polymer particles sticking to one another.

Having stated in general the concepts of this invention, a detailed description will now be made to the composition and structure of various heat-sensitive materials, the type of radiation source, and the exposure techniques used in the present invention.

FIGS. 1–8 are enlarged sectional views of seven types of heat-sensitive materials according to the present invention.

FIG. 9 diagrammatically illustrates a reflectographic flash-exposure method.

FIG. 11 is a diagrammatic drawing of an apparatus used in a transfer process described further on.

Figure 1:
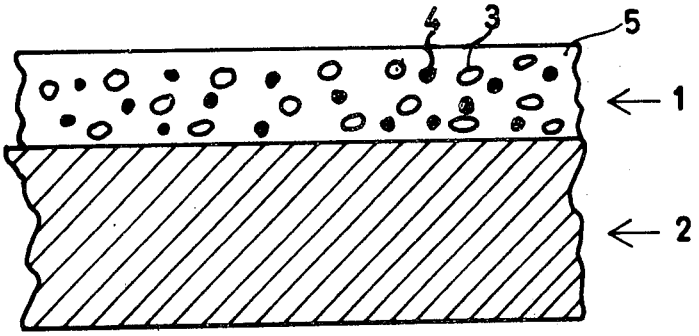

As is illustrated in FIG. 1 a heat-sensitive material can contain a heat-sensitive layer 1, which is applied to a support 2 and which comprises dispersed particles of a hydrophobic thermoplastic polymer 3 and particles 4 of a substance or substances capable of absorbing electromagnetic radiation and converting it into heat in a continuous phase of hydrophilic binder 5.

Figure 2:
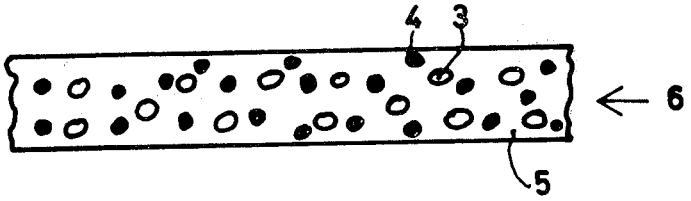

FIG. 2 shows a recording material in the form of a self-supporting sheet 6, formed by a dispersion of particles 4 absorbing electromagnetic radiation and thermoplastic polymer particles 3 in a hydrophilic binder 5.

Figure 3:
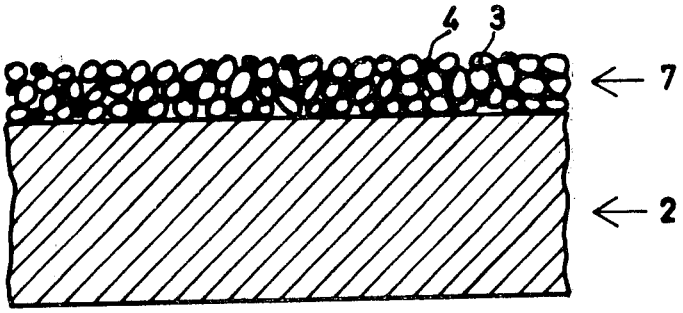

A heat-sensitive material can further contain, as is illustrated in FIG. 3, a heat-sensitive substantially dry porous coating 7 applied to a support 2, said coating 7 essentially consisting of hydrophobic thermoplastic polymer particles 3 and particles 4 of a substance capable of absorbing electromagnetic radiation and converting it into heat. The said coating 7 is preferably applied from an aqueous latex composition so that the polymer particles can be surrounded then by a hydration layer, which prevents the polymer particles from sticking but which can be destroyed by heat.

Figure 4:
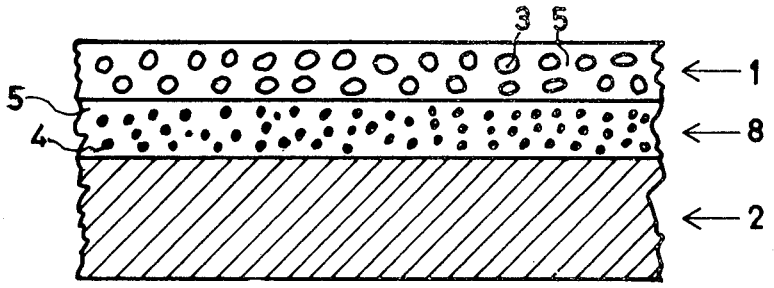

A heat-sensitive material can further contain as is illustrated in FIG. 4, a heat-sensitive layer 1, a support 2, and an intermediate layer 8 containing dispersed particles 4 of a substance capable of absorbing electromagnetic radiation and converting it into heat.

Figure 5:
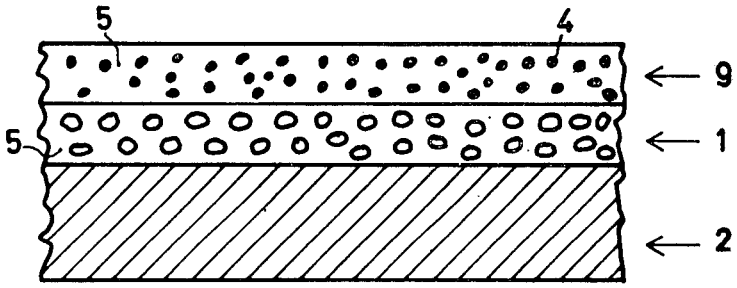

A heat-sensitive material can further contain, as is illustrated in FIG. 5, a top layer 9 containing dispersed particles 4 of a substance capable of absorbing electromagnetic radiation and converting it into heat and adjacent thereto a heat-sensitive layer 1 applied to a support 2.

Figure 6:
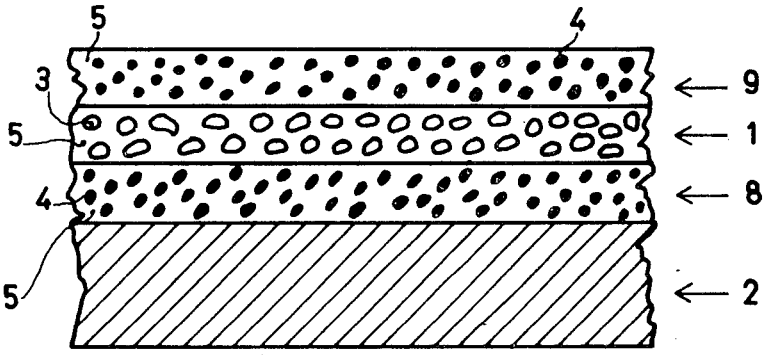

The heat-sensitive material can further contain, as is illustrated in FIG. 6, a heat-sensitive layer 1, a support 2, an intermediate layer 8, and a top layer 9, both last mentioned layers containing dispersed particles 4 of a substance capable of absorbing electromagnetic radiation and converting it into heat.

It will be apparent that in materials like those represented by FIGS. 4 to 6 wherein the electromagnetic radiation absorbing substance (whether in the form of particles or otherwise) is present in a layer other than the recording layer, the layer in which said electromagnetic radiation absorbing substance is present must not be so heat-conductive that the heat given off by said substance under intense irradiation with said radiation is dissipated along the layer. On the other hand the conduction of heat from the substance to the polymer particles must not be prevented. These factors must be taken into account in selecting the composition of the layer containing the electromagnetic radiation absorbing substances and the thickness of this layer.

Figure 7:
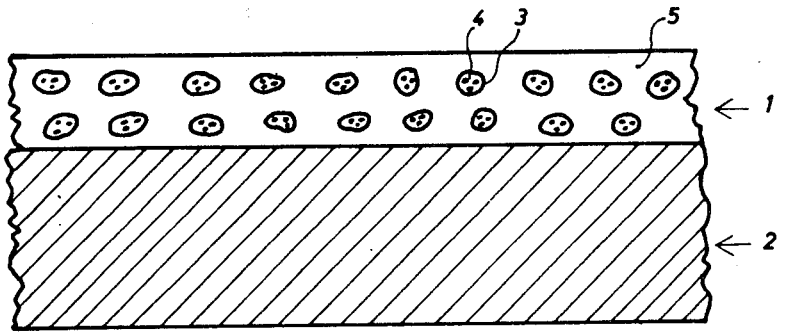

The heat-sensitive material can further contain, as is illustrated in FIG. 7, a heat-sensitive layer 1 applied to a support 2 said heat-sensitive layer containing in a hydrophilic binder 5 hydrophobic thermoplastic polymer particles 3, which contain dispersed particles 4 of a substance capable of absorbing electromagnetic radiation and converting it into heat.

The heat-sensitive material can also comprise a support which is impregnated with the heat-sensitive coating composition. Examples of such supports are those suitable for use in stencil preparation, e.g. Japan paper.

So far reference has been more particularly made to the use of the electromagnetic radiation absorbing substance in finely divided form (dispersed state) but it is to be understood that a said radiation absorbing substance may be in some other form, e.g., it may be present in dissolved state or may itself form a continuous phase or layer.

As already mentioned the heat-sensitive layers or self-supporting sheets for use according to the present invention may contain some amount of hydrophilic binding agent. Suitable hydrophilic binding agents are e.g. hydrophilic natural colloids, modified hydrophilic natural colloids, or synthetic hydrophilic polymers. More particularly they may be selected of water-soluble natural or modified natural hydrophilic colloids, as e.g. gelatin, glue, casein, zein, hydroxyethylcellulose, carboxymethyl-cellulose, methylcellulose, carboxymethylhydroxyethyl-cellulose, hydroxyethylstarch, gum arabic, sucrose octaacetate, ammonium alignate, sodium alginate and hydrophilic derivatives of such colloids. They may also be selected of such synthetic hydrophilic polymers as, e.g., polyvinyl alcohol, polyvinylpyrrolidone, polyvinylamine, polyethylene oxide, polystyrene sulphonic acid, polysorylic acid and hydrophilic copolymers and derivatives of such polymers.

Some of these polymers and derivatives thereof are soluble in water containing some alkali or acid.

The hydrophilic film-forming material used for the manufacture of a heat-sensitive recording layer or self-sustaining sheet according to the present invention may be hardened for obtaining a higher mechanical strength. Thus, a film-forming binding agent of the gelatin type may be hardened by reaction with an aldehyde such as formaldehyde or glyoxal. Also suited therefore are alum and hardening agents incorporated directly together with the colloid as an ingredient in the coating composition or applied afterwards by treating the layer or recording sheet with a solution thereof.

Application of the hardening agents as ingredients in the recording layer or sheet composition containing a hydrophilic binder is generally chosen as a function of the desired mechanical strength. The amount of hardening agent may range from 0.5 to 5% by weight. The treatment of the recording layer or self-sustaining sheet may be carried out with a solution having a concentration of 2 to 25% by weight of the hardening agent.

For the purpose of a wet or dry transfer of portions of the recording layer that were not image-wise exposed onto a receiving material, the hydrophilic binder preferably contains a softening agent. Suitable softening agents for gelatin are urea and potassium thiocyanate. Other suitable softening agents for gelatin are described in J. Phys. Chem. 60 (1956) 1299–1306. In the case a wet transfer is applied the softening agent may be present in the moistening liquid in order to improve the transfer of unexposed portions of the recording layer by pressing it on a receiving material.

The hydrophobilic thermoplastic polymer, which is the most important heat-sensitive substance of a recording element used according to the present invention, has to form a porous layer or water-permeable layer when coated from an aqueous dispersion at a temperature not substantially higher than room temperature and dried. The polymer particles preferably soften between 10° and 200° C above room temperature. As examples of suited polymers may be cited polymers having a melting point or a glass-transition temperature between 10° and 200° C above room temperature. More particularly are suited e.g. poly(ethylene) and poly(vinylidene chloride) having a melting point of 110° and 190° C respectively, and the following polymers with their respective glass-transition temperatures : poly(styrene) (100° C), poly(methyl methacrylate) (comprised between 70° and 105° C), poly(ethyl methacrylate) (50° C), poly(vinyl chloride) (near 70° C), poly(acrylonitrile) (near 100° C), poly(N-vinyl carbazole) (200° C).

As is known, the glass-transition temperature can be lowered by the addition of some substances called plasticizers. More particulars about suited plasticizers and the glass-transition temperature of homo- and copolymers can be found e.g., in George Champetier, Chimie Macromoleculaire —Generelites, Librairie Armand Colin —Paris Veme, p. 194–198. It appears therefrom that by copolymerisation or copoly-condensation a scale of glass-transition temperatures can be obtained according to the ratio of the monomer or condensation reagente used in the copolymerization and copely-condensation respectively. The molecular weight of the polymers usable in the process according to the present invention may vary within wide limits. Polymers possessing a molecular weight ranging from 5,000 to 1,000,000 are preferred. Poy)ethylene) possessing a molecular weight of 15,000 to 50,000 appeared to be very suited. Although there is some relationship between the melting point or glass-transition temperature and the sensitivity (imaging temperature) of the recording layer some other features seem to play also a role. So, it has been observed that with recording layers containing either poly(ethylene) (melting point : 100° C) or poly-vinylidene chloride (melting point : 190° C) recording layers with the same heat-sensitivity can be prepared.

The hydrophobic thermoplastic homopolymers and copolymers suited for the manufacture of a recording element according to the present invention can be applied as an aqueous dispersion, which may contain an hydrophilic binding agent. The aqueous dispersion of the homopolymer or copolymer is prepared preferably by radical polymerization in emulsion of one or more polymerisable monomers according to known techniques, e.g. those described by W. Serenson and T. W Campbeli, Preparative Methods of Polymer Chemistry, Interscience Publishers, New York (1961). In the radical polymerisation use is made of dispersing agents such as those described by K. Laox, "Die Grenzflachenskitven Stoffe" in Winnacker-Kichler's "*Chemische Technologic*" *Carl Hasen Verlag, Munich* (1960) p. 155–242.

Aqueous dispersion of polymers prepared by dispersing a solution of a water-insoluble polymer in a water-immiscible solvent in an aqueous solution of a hydrophilic binding agent are also considered. As solvents may be mentioned, e.g., chlorinated hydrocarbons, such as methylene chloride and trichloroethylene.

According to another technique aqueous polymer dispersion can be obtained by dispersing a molten thermoplastic polymer in water in the presence of wetting agents. In order to improve the dispersing properties the polymers may have in their structure a certain amount of hydrophilic groups as is the case in partly oxidized polyethylene.

Further, polymer dispersions, which are appropriate for application in the present invention can be obtained by dispersing in water mechanically finely divided polymer particles preferably with the help of surfactants and/or hydrophilic protective colloids such as poly(vinyl alcohol) and gelatin. Laticea obtained by emulsion polymerisation are preferred. In this polymerization technique the monomer is dispersed by stirring to very fine droplets in the presence of water, emulsifiers (soaps, ammonium clests, sulphonated fatty alcohols and the like), protective colloids (carboxymethylcellulose, poly(vinyl alcohol) and the like), a buffering system, a surfactant and a water-soluble catalyst, e.g. hydrogen peroxide or a permulphate. The polymer is obtained as a stable dispersion of polymer particles in water.

The polymer particles in dispersion may side from 0.01 $\mu$ to 50 $\mu$. However, the larger the particles, the less the resolving power on recording. Very good results are obtained with dispersions the dispersed polymer particles of which size from 0.05 $\mu$ to 2 $\mu$. Dispersion wherein the dispersed particles size from 1 $\mu$ to 1 $\mu$ are considered as colloidal systems. A colloidal system the continuous phase of which is formed by water (dispersing medium) and the dispersed phase is formed by particles sizing from 1 $\mu$ to 0.001 $\mu$ is called a hydrosol. Good results are obtained when using such hydrosols the polymer particles of which are not greater than 0.1 $\mu$. Good results are further obtained when using in the recording layer amounts by weight of thermoplastic polymer particles comprised between 0.5 g and 10 g/sq.m. The thickness of recording layers used in the present invention preferably varies between 0.5 $\mu$ and 10 $\mu$.

As was stated hereinbefore the heat-sensitive layer according to the invention need not contain a binder. The support and/or the drying technique of the layer may be chosen such that a natural adhesion occurs between the layer free from binding agent and the support. A slight sticking (e.g. by heating) of the polymer particles to one another and to the support without serious harm to the porosity of the layer enhances the mechanical strength thereof. Since a binder is not strictly necessary, the amount of hydrophilic binder in recording elements according to the present invention can vary between 0% and a relatively high percentage.

The amount of hydrophilic binder is mainly determined by the required hydrophilic-hydrophobic differentiation obtained by the image-wise heat treatment of the heat-sensitive layer. In general, however, a weight ratio of 1:1 of hydrophilic binder to hydrophobic thermoplastic particles is too high. On the other hand with a ratio of 3 parts by weight of hydrophobic thermoplastic particles to 2 parts by weight of hydrophilic binder to a very marked image-wise change from hydrophilic to hydrophobic and from permeable to impermeable, which is suited for the production of copies as well as for reproduction purposes, is obtained.

The temperature at which the heat-sensitive element undergoes a substantial lose in permeability is preferably in the range of 40°–200° C.

It is evident that the heat-sensitve material, before or during the creation of the image-wise differentiation, can be integrally heated to a certain temperature below the temperature of image formation of the heat-sensitive material. By such means the amount by which the temperature of the thermoplastic particles has to be raised in local areas by heat conduction from or heat exchange with the light-absorbing substance consequent upon its image-wise exposure to light is correspondingly reduced.

Segments suited for use according to the present invention and which convert visible light into heat, are e.g. carbon black, graphite, oxides or sulphides of heavy metals, particularly of those heavy metals having an atomic weight between 45 and 210, such as manganese or lead sulphide or these heavy metals themselves in finely divided state such as silver, bismuth, lead, iron, cobalt, or nickel. At present, preference is for carbon black as light-absorbing material in carrying out the invention.

Further suitable radiation-absorbing pigments and other data relating to radiation-absorbing substances are disclosed in the specification accompanying Belgian Pat. Specification No. 657,502. This specification should accordingly be read in conjunction herewith and be deemed to form part of the present disclosure.

According to a special modification of the recording element the hydrophobic thermoplastic polymer particles themselves may contain the substances absorbing visible light and converting it into heat. Such polymer particles can e.g. be prepared by carrying out the emulsion polymerisation reaction in the presence of such substances dispersed in the reaction medium.

As an example of an intimate mixture of dispersed pigment and polymer particles the following preparation of the dispersion of polyethylene and carbon black is given.

40 g of a partly oxidized polyethylene, prepared according to U. K. patent specification No. 997,135 by the oxidation of polyethylene and having an average molecular weight of 7000, a crystalline melting point of 130° C and an acid number of 26–30 are melted between 130° and 150° C. To the molten polyethylene are added 2.2 cos of 50% aqueous potassium hydroxide, 18 g of n-hexadecyloxy-decaoxyethylene, and then portionwise whilst stirring 20 g of carbon black having a particle size of about 0.04 $\mu$. A viscous black paste is obtained, which is allowed to cool to room temperature. Then the black polymer is finely ground and sieved through a 60 mesh sieve (mesh width : 0.25 mm).

In a heat-jacketed 800 autoclave, equipped with a thermometer, a manometer, and a stirrer are placed 60 g of the above finely ground black polymer mixture and 300 ccs of demineralized water. The dispersion obtained is heated to 90° C whilst stirring, whereupon the autoclave is sealed. Stirring is accelerated to 2000 rpm, while the temperature is raised to 150° C. After 30 minutes the autoclave is allowed to cool to room temperature. A homogeneous black dispersion is obtained of pH 8.3.

According to another modification a certain amount, taking into account the degree of required transparency of the recording material. or all of the hydrophobic thermoplastic polymer particles may contain in dissolved state a substance transforming electromagnetic radiation into heat, so that the transparency and heat-sensitivity of the recording element can be modulated by the polymer particles themselves.

The heat-sensitive layer may comprise from 0.01 to 1, preferably from 0.1 to 0.5% by weight of pigment calculated on the total weight of the layer. Black or deep black coloured pigments are preferred when no colours have to be reproduced. Particularly in the case of reflex printing, the optical density of the light absorbing layer (grep layer) should preferably be between 0.25 and 0.78.

For the recording of coloured originals the coloured substance or mixture of such substances absorbing only light of a part of the visible spectrum and converting that light into heat are preferably absorbing light of one of the primary colours (red, green, blue) or subtractive colours (cyan, magenta, yellow).

Substances which absorb visible light of a part of the visible spectrum and wherein absorbed light energy is transferred into heat are e.g. dyes belonging to the classes of the azo-, triarylmethane, xanthene-, acridine-, methine-, azine-, phthalocyanine, anthraquinone and allied dyes.

Said substances can be used in dispersed and/or dissolved state, and when used in dispersed form preferably in a grain size lower than 0.1 $\mu$.

The amount of said substances in a heat-sensitive element depends on the required heat-sensitivity of such an element, the intensity of the irradiation to be employed and the required yield of heat resulting from the irradiation of said substances.

When incorporated in the heat-sensitive material, said coloured substances are preferably used in the heat-sensitive layer itself in such an amount that an optical density of between 0.3 and 5 is obtained.

Coating of a heat-sensitive layer may be accomplished by conventional means such as by a roller coater, brush coater, spraying device, knife coater or by the use of an air-blade to control the thickness and distribution of the coating composition.

In a recording material comprising a recording or heat-sensitive layer on a support, the support of the recording layer may, according to the purpose of the material, be a rigid or a flexible member. The support may be permeable or impermeable e.g. it may be water-permeable such as a transparent web or textile. When flexibility is unimportant, plates of metal, glass or plastics, fiber board, cardboard or the like may be used.

According to their purpose the materials comprising a heat-sensitive element according to this invention mmay be built up differently. By way of example the heat-sensitive layer (whether or not comprising a hydrophilic binder) can be applied to a hydrophilic layer, which latter may be serve as a support. By hydrophilic layer a layer is understood that is wettable by water or by aqueous solutions. This layer may be porous or water-permeable. By way of example this hydrophilic layer may be composed mainly of natural or synthetic hydrophilic colloids. Examples of such layers are a gelatin layer, a light-sensitive silver halide emubion layer, a water-permeable nuclei-containing colloid layer for application of the silver complex diffusion transfer process, a colloid layer containing pigments or dissolved dyes, or containing reaction components capable of producing a colour reaction, a hydrophilic colloid layer containing developing substances for silver halide or complexed silver halide, or a hydrophilic colloid layer containing finely divided metal that can be etched away, e.g. silver.

In addition to a hydrophilic binder occasionally present in the heat-sensitive layer, said layer itself may contain all kinds of ingredients such as electro-conductive particles, e.g. carbon black, and dyes that can be bleached, distilled or sublimed, reaction components for the formation of dyes, catalysts for colour reactions, developing nuclei, light-sensitive substances, developing substances for silver halide or complexed silver halide, finely divided metal than can be etched away, reaction components that can be distilled preferably below 80° C, and other image-forming material. Further, this layer may comprise hardening agents for the hydrophilic binder and occasionally curing agents, which harden the hydrophobic thermoplastic polymer at elevated temperatures.

In this case of the application of a reflectographic exposure the concentration of said ingredients, however, may not be so high that the heat-sensitive layer becomes too opaque.

The heat-sensitive layer occasionally comprising a hydrophilic binding agent can also be applied to a hydrophobic layer, which may or may not serve as a support. By hydrophobic layer a layer is understood that is not or almost not wettable by water.

Such layers or supports are made e.g. of cellulose ester derivatives, polyesters, polystyrene, glass and the like.

Further, the heat-sensitive layer used in the present invention can be applied between two hydrophilic layers, two hydrophobic layers, a hydrophilic and a hydrophobic layer, between two permeable layers, two impermeable layers, or between a permeable and an impermeable layer.

A layer or sheet being in contact or water-permeable relationship with the heat-sensitive sheet or layer may contain ingredients that can be of practical interest to produce a visible image in accordance with the recorded best image, e.g. pigments, dyes, reaction components for the formation of dyes, developing substances, reaction components, or dyes that can be distilled or sublimed preferably below 80° C, developing nuclei suited for use in the silver halide diffusion transfer process, catalysts for colour reactions, conductive particles and light-sensitive substances.

The effectiveness of the recording with electro-magnetic radiation to be converted in heat depends in substance on the intensity of the radiant energy. For example, a recording element, which does not provide a sufficient physical differentiation in meltability, permeability, solubility and/or lyophility in the recording element with a particular source of energy, may be found fully effective if the energy level is substantially increased. With increased energy the distance between radiation source and recording element may be increased. Radiant energy absorbed in the absorbent printed areas of certain originals and converted to heat energy is more rapidly dissipated and prevented from effecting the contacting image-forming element when the radiant energy is of short duration and of a suitable high intensity. Lamp structures and systems capable of providing such increased intensity are available and form no part of the present invention.

Light sources with a high radiation intensity and relatively short exposure time are the so-called flash lamps and more particularly the gas discharge flash lamps. According to the present invention good results are obtained with a xenon gas discharge lamp, which can supply an energy of 300–1000 Watt. sec. in period of $10^{-4}$ to $10^{-2}$ seconds.

According to a preferred embodiment of the invention such a gas discharge lamp, which is in the form of a thin tube, is fitted in a hollow glass cylinder (see FIG. 9) in order to make possible a uniform exposure of the recording material applied to the periphery of the cylinder.

More details about such a gas discharge lamp for use in carrying out the invention are given in the specification filed in German application No. A46218, which specification should also be read in conjunction herewith and be deemed to form part of the present disclosure.

Evidently gas discharge lamps with a lower energy output can be used if the emitted energy is focused onto a relatively small heat-sensitive area. Su, e.g., a gas discharge lamp with an energy output of 40 Watt. sec. is suited for copying 6 cm × 6 cm and 6 cm × 9 cm originals on heat-sensitive materials as described in the present invention. For materials having an optical density of at least 1 resulting from the presence in the recording layer of light absorbing substances a light energy of 0.3 Watt. sec. per sq. cm will in practice suffice for desired image differentiation. It is further self-explanatory that exposure may be progressive and intermittent. In other words the heat-sensitive material may be scanned with an image-wise modulated light-spot of high intensity, e.g. a laser beam, or may be progressively exposed through a slit wherein, e.g., copying light of a continuously emitting tube-like radiation source is focused.

A great advantage of the thermo-copying process according to the present invention in comparison with the classical thermographic copying processes lies in the high sensitivity, the sharpness of the obtained images and the possibility to use visible light, which enables on to reproduce originals containing image-markings, which are not infra-red absorbing nor heat-conductive.

During the exposure through an original (transmission printing) the original is placed between the radiation source and the recording material. According to a first combination the heat-sensitive layer can be placed in contact with the original, occasionally by using a transparent inter-sheet or inter-layer. In this combination the support of the recording element can be opaque or transparent. According to another combination the recording material can be placed with its back-side (support), which in that case preferably is not heat-conductive, in contact with the original.

If the radiation is directed to the support of the recording material, it is important that said support be sufficiently transparent.

During reflectographic exposure the semi-transparent recording material has to be placed between the radiation source and the original. The original (negative or positive) comprises areas reflecting copying electromagnetic radiation or is a transparency having in contact with or near proximity of its back-side in element reflecting said radiation.

Before giving some examples for practising recording and reproduction of the present invention, a short survey is given of different systems, which are suited for the manufacture of copies and masters for the reproduction of originals starting from a heat-recording material according to the present invention. This survey is intended for illustrating the possibilities and advantages of the invention without limiting therefore the scope of this invention.

According to a first system, the image-wise differentiation in permeability and hydrophility obtained by exposure is utilised for applying by image-wise diffusion image-forming substance or substances in the recording element by a liquid treatment or transferring such substances from the recording element to a receiving material respectively, said image-wise diffusion being possible as a consequence of this differentation. By way of example for the first embodiment said imaged recording material is dipped into an aqueous dye solution, so that the dye can diffuse in the recording element (layer or sheet) only at the areas that remained permeable and sufficiently hydrophilic. Of course, a solution of a catalyst for initiating a colour reaction between components in the recording material or a solution of a colourless reaction component capable of giving a colour reaction with a colourless or slightly coloured reaction component in the recording material can be used instead of a dye solution.

By way of example for the second embodiment it is possible to incorporate into the recording element coloured substances that can be bleached out and which are bleached by a bleaching agent diffused in the areas of the recording material that remained permeable. According to an alternative of that embodiment, a conductive substance, e.g. a metal that can be etched away, such as colloidal silver, and that is homogeneously dispersed in the recording element, is image-wise etched away by the etching liquid diffusing into the permeable areas. The heat-sensitive layer can be applied to an etchable base material, e.g. a zinc or copper plate. When using this material it is possible to produce a letter-type or intaglio printing master by etching.

In a second embodiment of image-formation wherein diffusion is applied, the image-forming substances incorporated in the recording material is transferred by diffusion from the areas that remained permeable to an image-receiving material. So, it is possible, e.g., to incorporate a soluble dye into the recording element or into a layer being in a liquid-permeable relationship therewith, said dye being capable of diffusing therefrom image-wise to a receiving material when the heat-recording element is wetted.

According to an interesting technique the heat-sensitive layer or adjacent as well as subjacent layer comprises a liquid or solid substances, e.g. dyes, in incapsulated form. After image-wise impermeabilisation of the heat-sensitive layer pressure is exerted on the surface of the recording material. As a result of this pressure the capsules burst so that the contents are at disposal at those areas of the heat-sensitive layer that remained permeable.

Through these areas having remained permeable contents of the capsules can be transferred, e.g. to a receiving material (recording process requiring no processing liquid or bath). The preparation of suitable capsules is described i.a. in the U.K. patent applications Nos. 6860/63, 27,401/63, 27,402/63, and 27,403/63.

Instead of a dye, a colourless reaction component or catalyst, whether or not in incapsulated form, for bringing about a colour reaction with a reaction component in the receiving material can obviously be incorporated in the recording element.

It is also possible among others to incorporate into the recording material silver salts, which can be complexed and which in their dissolved form can diffuse to a receiving material containing reduction nuclei or development nuclei, whereupon according to the areas of the recording material that remained permeable, silver is deposited image-wise.

In these diffusion methods the image-forming substances such as a dye, a metal that can be etched away, or reaction components need not be present in the recording element itself. They can also be incorporated into a layer or support being in premeable relationship therewith.

According to another embodiment the recording material, e.g. as a self-sustaining sheet, after exposure can form an image-wise water-permeable membrane through which, by way of example, an aqueous dye solution can diffuse continuously. In this way a hydrotype master is obtained by means of which several copies of the original can be printed on transfer material.

Said membrane can also be used for electrolytic printing since the said membrane being in close surface contact with a receiving material as an electrode only transmits electrolyte through the permeable portions with the result that an image-wise electrolytic deposit of image substance is formed on said electrode material.

According to a second system the areas of the heat-recording material that remained permeable and soluble are eliminated, e.g. by washing out or degrading of the hydrophilic binder. In that case the recording element may comprise a dye, e.g. a (coloured) pigment or a dissolved dyestuff so that on eliminating by liquid the image areas that remained permeable, a copy of the original is obtained.

By applying said second system a gravure master can be produced starting from a heat-imaged recording layer, which is applied to a metal support that can be etched. After elimination of the portions of the recording layer that remained permeable and hydrophilic, e.g. by washing out, the uncovered metal can be etched away image-wise. In this way, e.g., printed circuits can be produced. After the elimination, e.g. by means of an organic solvent, of the residual portions of the recording layer, the etched metal plate is ready for being used as a gravre master.

By applying said second sytem, a letterpress master can be manufactured by merely washing away the portions of the heat-imaged recording layer that remained permeable and hydrophilic, said washing process being followed, if needed, by the hardening of the impermeabilised portions of the recording layer. In this way the impermeabilised portions form a relief image.

When the recording layer is applied to a strongly conductive support, e.g. of aluminium, an electrostatic printing plate can be made of this material after heat-imaging. By washing away the permeable portions of the recording layer recording to the present invention containing, e.g., a hydrophilic binder, the conductive material is uncovered image-wise. The portions of the recording layer that were made impermeable possess a considerably higher electric resistivity than the strongly conductive support. By this difference of electric resistivity and by the insulating character of the remaining polymer portions, an electrostatic charge pattern can be formed in accordance with said polymer portions by electrostatically charging. These portions can either be developed in a known way, e.g. by means of powder, or be utilised for the image-wise transfer of electric charges to an insulating transfer sheet. Alternatively, the so-treated recording material can be used as an electrostatic printing form or as a material containing a permanent conductivity image. Such material and the use thereof are described in the U. K. Pat. Specifications Nos. 964,872 and 983,841.

By applying said second system also a stencil or screen-printing master can be manufactured starting from a heat-imaged recording material according to the invention. For this technique one or both sides of a screening material are coated with a recording layer or the screening material makes part of a self-sustaining sheet as described herein-before. As screening material Japen paper (Yoshino paper), nylon fabrics with a size of mesh of 0.2 to 0.08 mm and woven bronze wire are particularly suited (see example 5).

From the screen-printing technique it is known that only at the open (permeable) areas of the fabric (screening material) ink can pass and deposit on the material to be printed conformably to these areas. The image-wire open areas are obtained according to the present invention by washing out or etching away the recording layer composition except for the screening material at the areas where this layer or sheet remained permeable and hydrophilic.

According to a third system the image areas that remained permeable and hydrophilic are transferred to a receiving material in wet and/or heated state by squeegeeing and tearing out.

This type of transfer is possible if the cohension of the matter of the receiving material is stronger than that of the matter in the permeable areas of the recording layer and if the adhension between said permeable areas and the receiving material is stronger than the cohension of the matter of said permeable areas.

This transfer successfully occurs when separating after pressing together a wetted image-wire exposed recording material from a receiving material preferably having a hydrophilic and/or porous surface. In that case the recording material preferably comprises either a recording layer containing a hydrophilic binder wherein the hydrophobic thermoplastic polymer particles are dispersed or a recording layer built up by a porous coating of the said polymer particles applied to a hydrophilic, preferably a colloid layer capable of swelling considerably.

The contrary type of transfer is possible if the cohension of the substance in the contacting material, called in that case transfer material, is less than that of the substance in the permeable areas of the recording layer and if the adhension between said permeable areas and the transfer material is stronger than that of the substance of said transfer material. For example a dye layer of a carbon paper having a scarcely hydrophobic surface such as is used in the process according to the U. K. patent specification No. 996,963, after being pressed onto the moistened image-wise to the permeable and hydrophilic areas of the recording material on separating it therefrom. Before pressing the recording material onto a dye layer the hydrophilic binder of said material can be swollen so that a relief image is formed that makes possible a closer contact with the dye layer.

According to this third system it is thus possible to manufacture hectographic masters since the torn out material can contain a hectographic dye that is soluble in a spirit duplicating liquid or can contain a reaction component capable of forming a dye with a reaction component present, e.g., in such a liquid or transfer material.

According to a special modification of the third system it is possible by the use of a layer of (a) polymer(s) that soften(s) at low temperature i.e. under the temperature at which the heat-sensitive recording element become less permeable, and which is located beneath the recording layer to transfer the unexposed areas of the heat-sensitive layer together with a stratum of softened polymer to a receiving material by pressing the heat-sensitive layer of the exposed recording material against a receiving material, e.g. paper, while heating, e.g. between two heated rollers, and finally by separating both materials. (Recording process without processing liquid).

Figure 8:
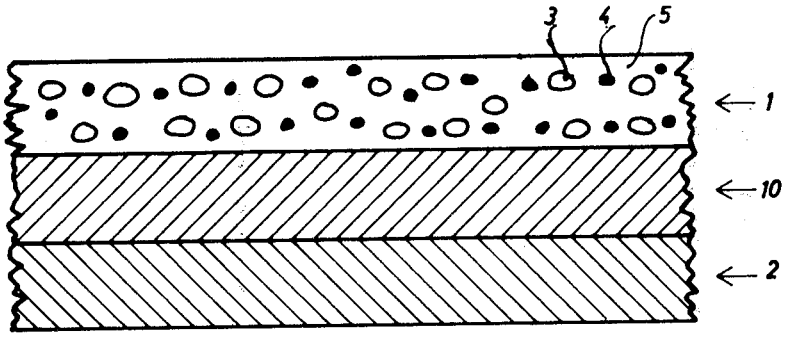

The composition of a recording material suited for use in this process is illustrated in FIG. 8. This recording material comprises a heat-sensitive layer 1, which is applied to a polymer layer 10 having a softening point below the temperature at which the heat-sensitive layer is impermeabilised. The polymer layer is applied to a support 2. The heat-sensitive layer contains diapersed particles of a hydrophobic thermoplastic polymer 3 and particles 4 of a substance or substances capable of absorbing visible light and converting it into heat in a continuous phase of hydrophilic binder 5.

According to a fourth system it is possible by the use of a low melting substance (e.g. a dye) in the recording layer itself, to transfer this dye by melting the recording layer in contact with a transfer material.

According to a fifth system the exposed recording material comprising an image-wise hydrophilic-hydrophobic differentiation is used for planographic printing either with a fat printing ink using in that case a damping system or with an ink consisting of a mixture of a coloured aqueous phase and a colourless or almost colourless oleophilic phase as described in the U. K. patent application 7800/65 which should be read in conjunction herewith.

Multicolour images can be produced by using a heat-sensitive material according to the present invention and containing more than one heat-sensitive element. So, it is possible, e.g., to record at least two of the colours used for subtractive colour mixture of a multicolour original in terms of a differentiation in permeability and/or lyophility in one material by using a recording material of the type described above containing a transparent support having at one side thereof a heat-sensitive layer containing, e.g., a red dye and at the other side a heat-sensitive layer containing a green dye or blue dye.

Multicolour printing is also possible. For that purpose three heat-sensitive materials are preferably used containing a heat-producing substance absorbing light in the red, the green and blue region of the spectrum respectively, i.e., materials containing a cyan substance, a magenta substance and a yellow substance respectively.

The heat-sensitive material containing the cyan substance and which is sensitive to red light, by the heat produced therein is made impermeable and hydrophobic in the areas corresponding with the red areas of the original.

The heat-sensitive material containing the magenta substance and which is sensitive to green light, by the heat produced therein is made impermeable and hydrophobic in the areas corresponding with the green areas of the original.

The heat-sensitive material containing the yellow substance and which is sensitive to blue light, by the heat produced therein is made impermeable and hydrophobic in the areas corresponding with the blue areas of the original.

Multicolour prints can be produced by using the obtained masters to print in register.

According to the printing system applied hydrotype (aqueous ink see, e.g., U. K. patent application No. 7800/65 or offset-printing (lipophilic ink) inks having the colours used for substractive colour mixtures (cyan, magenta, yellow) or inks having the colours used for additive colour mixtures (red, green, blue) are used.

For reproducing originals which contain separate markings in the pure primary colours blue, green and red (e.g. a letter heading containing blue, green and red letters) three separate heat-sensitive materials are used, which are sensitised for yellow, magenta and cyan respectively by a blue, green and red dye or pigment being uniformly distributed in the heat-sensitive layer at the time of the exposure to white light.

The following examples illustrate the invention.

EXAMPLE 1

To a cellulose triacetate sheet provided with a gelatin subbing layer a layer is applied pro rata of 12.5 sq. m. per kg from the following solution:

| | | |
|---|---|---|
| 6 % | aqueous gelatin | 650 ccs |
| 5 % | aqueous pyrogallol | 100 ccs |
| 11 % | aqueous saponin | 20 ccs |
| water to | | 1000 ccs |

On drying, a heat-sensitive layer is coated thereon pro rata of 10 sq. m. per kg from the following coating composition:

| | | |
|---|---|---|
| 50 % | aqueous carbon dispersion | 1 cc |
| 3 % | aqueous gelatin | 400 ccs |
| 40 % | aqueous emulsion of polyethylene having a particle size of less than 0.1 μ and an average molecular weight comprised between 15,000 and 30,000 | 160 ccs |
| 3 % | aqueous solution of the condensation product of oleic acid and methyltaurine | 140 ccs |

Figure 9:
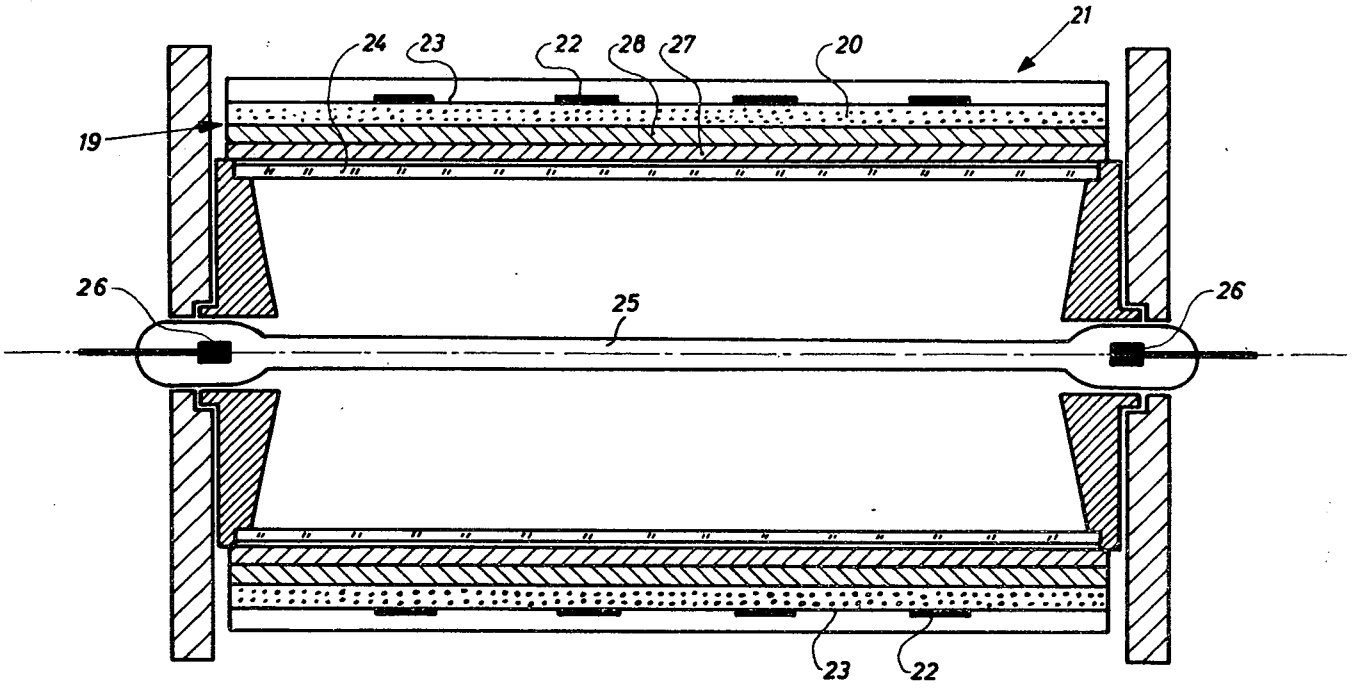

After drying, the copying material obtained possesses an optical density of 0.27 measured by transmittance. As schematically represented by FIG. 9, the obtained copying material 19 is then laid on an original 21 comprising radiation-absorbing markings 22 and a radiation-reflecting background 23, the heat-sensitive layer 20 facing the original.

In this way the copying material 19 consisting of the cellulose triacetate support 27, the gelatin prelayer 28 and heat-sensitive layer 20 is pressed against a glass cylinder 24 having a diameter of 8 cm. In the axis of this cylinder a xenon gas discharge lamp 25 is placed, which on discharge between the electrodes 26 produces a radiation energy of 610 watt.sec. in 1/2000 sec. at 4 cm of the original. This radiation mainly consists of visible light. After exposure, the heat-sensitive material 19 is used as duplicating master by dipping it in water for 15 sec. and, after having removed the surplus water, by pressing it against a receiving paper containing iron-(III) chloride. This receiving paper was prepared by dipping common writing paper into 1 % aqueous iron-(III) chloride and drying. According to this process, six bluish-black prints of the original formed by reaction of the iron(III) chloride with pyrogallol in the permeable parts of the master can be obtained by wetting the master again after each contact with a sheet of receiving paper.

EXAMPLE 2

A poly(ethylene terephthalate) support of 0.1 mm thickness provided with a subbing layer for gelatin is coated with the following solution pro rata of 50 g/sq.m.:

| | | |
|---|---|---|
| 10 % | aqueous gelatin | 935 g |
| 10 % | aqueous saponin | 30 g |
| 3 % | aqueous HOSTAPON T (registered trade mark) | 30 g |
| 4 % | aqueous formaldehyde | 5 g |

After solidfying, a heat-sensitive layer is applied thereto from the following composition pro rata of 36 g/sq.m.:

| | | |
|---|---|---|
| 10 % | aqueous gelatin | 100 g |
| 40 % | aqueous dispersion of polyethylene having a particle size of less than 0.1 μ and an average molecular weight comprised between 15,000 and 30,000 | 160 g |
| | aqueous carbon dispersion containing pro 100 g 53 g of carbon, 23 g of water, 18 g of glycol and 6 g of nonylphenyl-polyethylene oxide | 8 g |
| 5 % | aqueous solution of TERGITOL 4 (registered trade-mark) | 80 g |
| 4 % | aqueous formaldehyde | 5 g |
| water | 640 | g |

Figure 10:
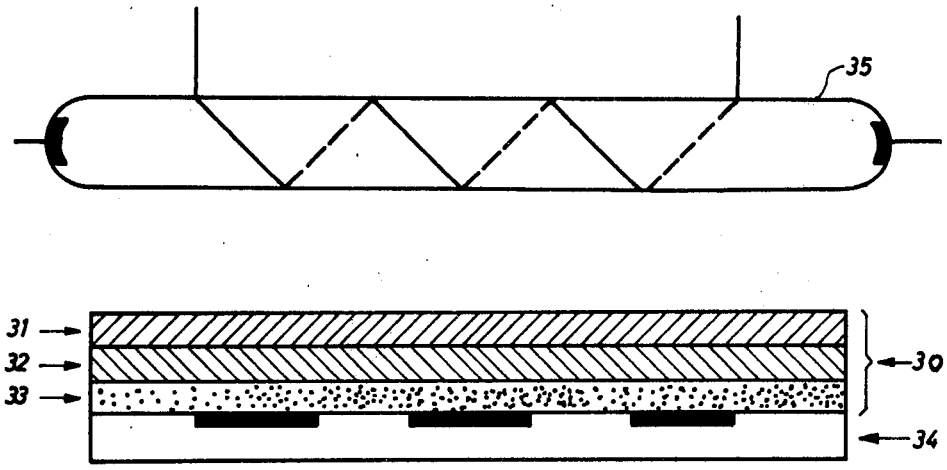
FIGS. 10, 12 and 13 are schematical drawings of recording elements in combination with an exposure device.

After drying, the heat-sensitive copying material 30 (FIG. 10) obtained comprising a poly(ethylene terephthalene support 31, a gelatin interlayer 32 and a heat-sensitive layer 33 is exposed together with an original 34 to be reproduced, as schematically illustrated in FIG. 10, with a xenon gas discharge lamp 35 irradiating the thermo-sensitive material with an energy of 0.8 Watt.sec./sq.cm.

The exposed material is braced on the printing cylinder of a planographic printing apparatus and inked thereon with an ink of the following compositon:

| | |
|---|---|
| aqueous carbon dispersion containing 53 g of carbon, 23 g of water, 18 g of glycol, and 6 g of nonylphenylpolyethylene oxide | 100 g |
| 80 % aqueous solution of a partly etherified melamineformaldehyde resin | 20 ccs |
| copoly(vinyl acetate/ammonium crotonate (95/5) | 27 g |
| 1,5-hexanediol | 27 g |
| 10 N ammonium hydroxide | 2 g |
| urea | 6.5 g |
| 53 % aqueous dispersion of copoly(butyl acrylate/vinyl acetate) (50/50) | 13 g |
| white spirit (boiling range : 180–200° C) | 80 g |
| xylene | 20 g |

Only the areas corresponding with the image areas of the original are wetted with the aqueous coloured phase of the ink. By means of the planographic printing machine and the regular supply to the copying material of said ink, black prints are obtained from the original on common paper acting as a receiving material.

The same results are obtained when in the composition of the heat-sensitive layer the amount of 8 g of said carbon dispersion is replaced by 30 ccs of a 10 % aqueous dispersion of finely divided silver.

EXAMPLE 3

A material as described in example 2, after being exposed as described in example 2, is slightly wetted with water and then with its heat-sensitive layer pressed against a receiving paper 36. The material and the receiving paper are led between two pressure rollers 37 and 38 (FIG. 11) at a travelling speed of about 10 cm/sec., the latter roller being heated to 35° C. On emerging from between the rollers, both materials are immediately peeled apart. A thin stratum of the heat-sensitive layer is transferred image-wise to the receiving paper so as to form a legible print in accordance with the original.

EXAMPLE 4

After being exposed as described in example 2, the material as described in example 2 is slightly wetted and pressed against the dyestuff layer of a hectographic carbon carrying no hydrophobic surface layer. After a contact time of about 1 min. both layers are separated. At the areas corresponding with the image areas of the original part of the dyestuff is transferred, so that a dyestuff-containing laterally reversed image of the original is obtained. This material can be utilized as a spirit duplicating master.

EXAMPLE 5

A Japan paper weighing 14 g/sq.m. is dipped in a solution consisting of:

| | |
|---|---|
| 10 % aqueous gelatin | 200 g |
| 40 % dispersion of polyethylene as described in example 2 | 200 g |
| water | 400 g |
| carbon dispersion as described in example 2 | 2.5 g |
| 5 % aqueous solution of sodium tetradecyl sulphate | 40 g |

When dried, this coated Japan paper possesses a weight of 20 g/sq.m. The treated paper is exposed to an electronic flashlight unit in the same way as described in example 2. Subsequently, the material is dipped in a 5% aqueous solution of sodium salicylate and the areas corresponding with the image areas of the original are washed away.

After rinsing and drying, a stencil of the original is obtained.

EXAMPLE 6

A paper support weighing 60 g/sq.m. provided with a baryta coating is covered pro rata of 36 g/sq.m. with a layer from the following composition:

| | |
|---|---|
| 10 % aqueous gelatin | 150 g |
| 40 % dispersion of polyethylene as described in example 1 | 80 g |
| 10 % aqueous dispersion of colloidal silver | 200 g |
| 5 % aqueous solution of sodium tetradecyl sulphate | 40 g |
| 4 % aqueous formaldehyde | 2.5 g |

The resulting layer is dried and the copying material 40 obtained (see FIG. 12) containing the heat-sensitive layer 41 applied to the transparent cellulose triacetate support 42 is exposed to a xenon gas discharge lamp 35 behind a developed silver halide emulsion layer 43 containing a negative screen print of an original on a transparent practically non-heat conductive support 44 with an energy of 1.3 watt.sec./sq.cm.

Subsequently, the material is dipped in a conventional bleaching bath. Only in the areas corresponding with the opaque parts of the negative silver is bleached out so that a positive print of the photographic negative is obtained.

EXAMPLE 7

To a cellulose triacetate support provided with a subbing layer for gelatin a first layer is applied from the following composition pro rata of 50 g/sq.m.:

| | |
|---|---|
| 10 % aqueous gelatin | 900 ccs |
| 10 % aqueous saponin | 30 ccs |
| 5 % aqueous solution of the condensation product of oleic acid and methyltaurine | 30 ccs |

After drying, a second layer is applied thereto pro rata of 36 g/sq.m. from the following composition:

| | |
|---|---|
| 10 % aqueous gelatin | 50 ccs |
| 40 % aqueous dispersion of poly(vinyl chloride) | 80 ccs |
| aqueous carbon dispersion as described in example 2 | 4 ccs |
| 4 % aqueous formaldehyde | 2.5 ccs |

After drying, the material thus obtained is exposed together with an original, in the same way as described in example 2, but with an energy of 1 watt.sec./sq.cm. The material is then dipped in 5% aqueous addition of methylene blue so that a laterally reversed positive print legible through the back of the support is obtained from the original.

EXAMPLE 8

To a cellulose triacetate support provided with a subbing layer for gelatin a first layer is applied pro rata of 15 g/sq.m. from the following composition:

| | |
|---|---|
| 10 % aqueous gelatin | 400 g |
| 5 % aqueous saponin | 30 g |
| 5 % aqueous solution of the condensation product of oleic acid and methyltaurine | 30 g |
| 4 % aqueous formaldehyde | 10 g |
| 10 % aqueous dispersion of colloidal silver | 200 g |

After drying, a second layer is applied thereto pro rata of 36 g/sq.m. from the following composition:

| | |
|---|---|
| 10 % aqueous gelatin | 50 g |
| polyethylene dispersion as described in example 2 | 80 g |
| 5 % aqueous solution of sodium tetradecyl sulphate | 40 g |

This material is exposed as described in example 6, but with an energy of 0.9 watt.sec./sq.cm. Subsequently it is treated in the same way as described in example 6 in order to produce a positive print.

EXAMPLE 9

A 7% aqueous solution of gelatin is applied in a proportion of 7 g of gelatin per sq.m. to a cellulose triacetate support. After drying the following composition is coated thereon in a proportion of 36 g/sq.m. and dried.

| | |
|---|---|
| 10 % aqueous solution of gelatin | 100 g |
| 40 % colloidal aqueous dispersion of polyethylene having a particle size less than 0.1 $\mu$ and an average molecular weight comprised between 15,000 and 30,000 | 160 g |
| water | 715 g |
| 5 % aqueous solution of sodium tetradecyl sulphate | 20 g |
| Pigment grun B Colanyl Teig, (C.I. 10006) | 10 g |

The exposure of said material is illustrated by FIG. 10. The recording material 30 comprising the cellulose triacetate support 31, the gelatin interlayer 32 and the heat-sensitive polyethylene-containing layer 33 is reflectographically exposed with a xenon gas discharge lamp 35 producing a light energy of 1000 watt.sec. in 1/2000 sec. at 4 cm of the original to a graphic colour original 34. The said original has black, blue, green and red letter marks on a white background.

After exposure the recording material is dipped in a 5% aqueous solution of methylene blue. Since the dye solution penetrates into the recording layer only in the areas corresponding with the non-light reflecting image areas (black areas) and image areas which are coloured green (said image areas absorb blue and red), a laterally reversed blue copy (legible through the back of the support) of only the black and green letter marks of the original is obtained.

When in the above described heat-sensitive layer the green pigment "Pigmentgrun B Colanyl Teig" I.) is replaced by a same amount of "Heliogenblau B Colanyl Teig" (C.I.74160) and the obtained material is exposed in the same as described above all the letter marks with exception of the red letter marks are reproduced.

When in the above described heat-sensitive layer the green pigment "Pigmentgrun B Colanyl Teig" (C.I.10006) is replaced by a same amount of "Permanent Violett R.L. Colanyl Teig" a 30 % aqueous dispersion of Sirius lightblue FF 2 GL (C.I.51300) and the obtained material is exposed as described above, a copy of the original showing the different letter marks in equal density of methylene blue absorbed is obtained.

When the exposed material containing "Permanent Violett R.L. Colanyl Teig" in the heat-sensitive layer is braced on the printing cylinder of a planographic printing apparatus and inked thereon with an ink of the following composition:

| | |
|---|---|
| aqueous carbon dispersion containing 53 g of carbon, 23 g of water, 18 g of glycol and 6 g nonylphenylpolyethylene oxide | 100 g |
| 80 % aqueous solution of partly etherified melamine formaldehyde resin | 20 g |
| copoly(vinyl acetate/ammonium orotenate) 95/5 | 27 g |
| 1,5 hexanediol | 27 g |
| 10 N ammonium hydroxide | 2 g |
| urea | 2 g |
| 53 % aqueous dispersion of copoly (butyl acrylate/vinyl acetate)50/50 | 13 g |
| white spirit (boiling range : 180–200° C | 80 g |
| xylene | 20 g |

Only the areas corresponding with the image areas of the original are wetted with the aqueous coloured phase of the ink.

By means of the planographic printing machine and the regular supply to the copying material of said ink, black prints are obtained from the original on common paper acting as receiving material.

EXAMPLE 10

A polyethylene terephthalate support of 0.1 mm thickness provided with a subbing layer for gelatin is coated with the following solution pro rata of 50 g/sq.m.

| | | |
|---|---|---|
| 10 % | aqueous solution of gelatin | 965 g |
| 3 % | aqueous solution of the condensation product of oleic acid and methyltaurine | 15 g |
| 10 % | aqueous solution of saponin | 15 g |
| 4 % | aqueous solution of formaldehyde | 5 g |

After solidifying a heat-sensitive layer is applied thereto from the following composition pro rata of 36 g per sq.m.

| | | |
|---|---|---|
| 10 % | aqueous solution of gelatin | 50 g |
| 40 % | aqueous dispersion of polyethylene having a particle size of less than 0.1 $\mu$ and an average molecular weight comprised between 15,000 and 30,000 | 80 g |
| 7 % | aqueous solution of 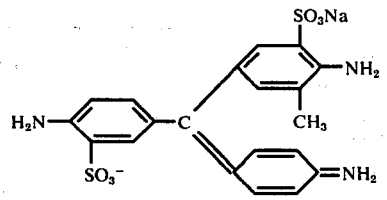 | 128 g |
| 5 % | aqueous solution of 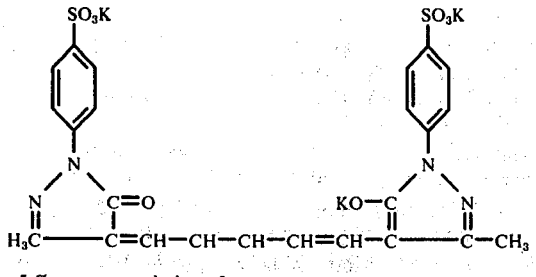 | 24 g |
| 5 % | aqueous solution of | |

-continued

| | |
|---|---|
| 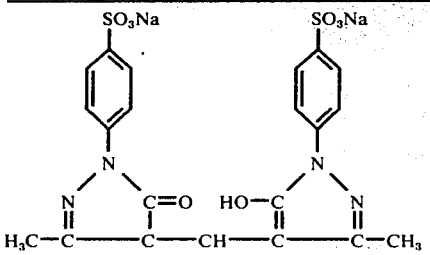 | 124 g |
| 5 % aqueous solution of sodium tetradecyl sulphate | 10 g |
| water | 200 g |

Figure 11:
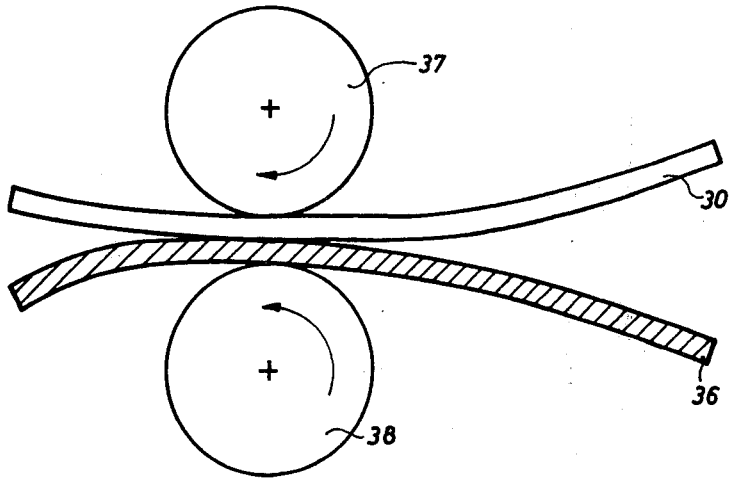

After drying the heat-sensitive material is exposed to an original as described in example 10. After exposure said material is slightly moistened with water and with its heat-sensitive layer pressed against a receiving paper as illustrated in FIG. 11. The heat-sensitive material 30 is led together with a receiving paper 36 between two pressure rollers 37 and 38 at a travelling speed of about 10 cm per sec, the roller 38 being heated to 35° C.

On emerging from the rollers the materials are immediately peeled apart, the receiving paper bearing a legible print of the original showing the different letter marks in equal density.

EXAMPLE 11

To a cellulose triacetate support provided with a subbing layer for gelatin, a first layer is applied from the following composition pro rata of 30 g/sq.m.: 1

| | | |
|---|---|---|
| 10 % | aqueous gelatin | 300 g |
| 9 % | aqueous urea | 170 g |
| 10 % | aqueous saponin | 30 g |
| 3 % | aqueous solution of the sodium salt of the condensation product of oleic acid and methyltaurine | 20 g |

Before coating this composition, its pH is adjusted to 4 with hydrogen chloride. After drying, a second layer is applied thereto from the following composition pro rata of 30 g/sq.m.

| | | |
|---|---|---|
| 10 % | aqueous gelatin | 50 g |
| | water | 350 g |
| 35 % | aqueous emulsion of polyvinylidene chloride, prepared as described hereinafter | 90 g |
| 5 % | aqueous solution of sodium tetradecyl sulphate | 25 g |
| | aqueous carbon dispersion as described in example 2 | 4 g |

After drying, the recording material 30 (FIG. 10) comprising a support 31, a gelatin interlayer 32 and a heat-sensitive layer 33 is exposed together with an original 34 as schematically illustrated in FIG. 10, with a xenon gas discharge lamp 35 irradiating the heat-sensitive material with an energy of 0.9 Watt.sec./sq.cm.

After being exposed the material is slightly wetted with water of 22° C and then with its heat-sensitive layer pressed against a blank planographic printing paper base, viz. a so-called Gevalith (trade-name) paper composed of a paper support to which a baryta coating containing hardened gelatin has been applied as a binder at a ratio of 50 g/sq.m.

The material and the printing paper are led between two pressure rollers at a travelling speed of about 10 cm/sec., both rollers being at room temperature. On emerging from between the rollers, both materials are peeled apart. The heat-sensitive layer is transferred image-wise to the receiving paper so as to form a legible print in accordance with the original.

The image-bearing printing plate thus obtained was exposed once more to a flash discharge and was braced onto a conventional offset printing machine and produced clear and sharp copies of the original.

Preparation of poly(vinylidene chloride) latex

In a heat-jacketed 800 cca autoclave equipped with a stirrer, a thermometer, a manometer and an inlet for the reagents are placed successively:

| | | |
|---|---|---|
| | dimineralized water | 120 ccs |
| 10 % | solution of the sodium salt of the condensation product of oleic acid and methyltaurine in demineralized water (i.e. 2 % by weight of monomer) | 32 ccs |
| 10 % | solution of the compound of the formula 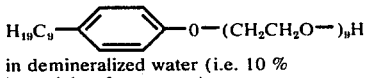 in demineralized water (i.e. 10 % by weight of monomer) | 160 ccs |
| 2 % | solution of potassium persulphate in demineralized water | 40 ccs |
| 5 % | solution of sodium hydrogen sulphate in demineralized water | 8 ccs |
| | vinylidene chloride | 160 g |

The reaction mixture is heated to 60° C with hot water whilst stirring at 1000 rpm. After 30 minutes at this temperature, a pressure of 1.5 to 2 kg/sq.cm is attained in the autoclave. After a polymerisation time of 3 h at 60° C the pressure starts to drop and 2½h later thereis a partial vacuum in the autoclave. After 1 further h at 60° C the reaction mixture is cooled to room temperature and collected. A white latex is obtained of pH 2. By the addition of some cos of 2N NaOh and pH is adjusted to 7. Contents of solid matter : 35%.

EXAMPLE 12

A poly(ethylene terephthalate) support of 0.1 mm thickness provided with a subbing layer for gelatin is coated pro rata of 30 g/sq.m. from the following composition:

| | | |
|---|---|---|
| 10 % | aqueous solution of polyvinyl alcohol | 55 g |
| 10 % | aqueous solution of polyvinylpyrrolidene | 22 g |
| 20 % | aqueous dispersion of polyethylene prepared as described hereinafter | 120 g |
| | water | 70 g |
| | aqueous carbon dispersion containing pro 100 g 53 g of carbon (average particle size 0.1 p), 23 g of water, 18 g of glycol and 6 g of nonyl phenyl polyethylene oxide | 40 g |
| 3 % | aqueous solution of sodium tetradecyl-sulphate | 18 g |

Figure 12:
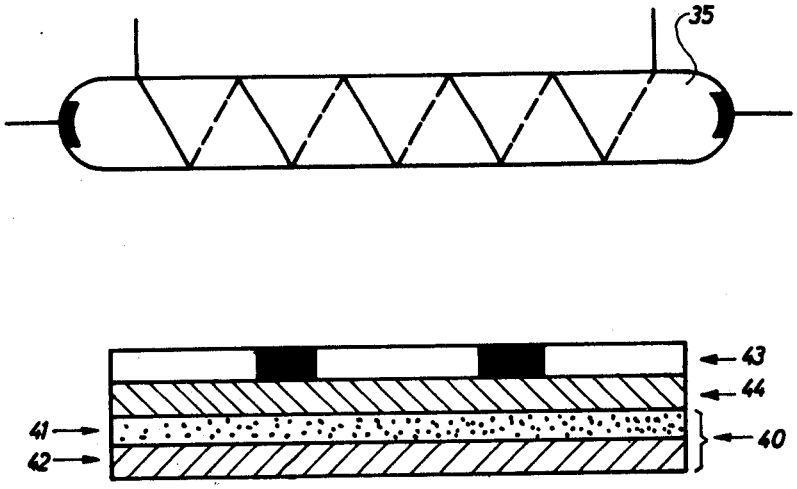

After drying, the material is contact-exposed as schematically illustrated by FIG. 12 through a negative transparency being a reproduction of a screened image. The exposure is carried out by means of a xenon gas discharge tube placed at a distance of 4 cm of the recording layer, which is concentrically arranged round said tube. The light source has a capacity of 800 Watt.-sec., producing light in a time of $1.10^{-4}$ sec.

After exposure, the layer is rubbed with a cotton pad soaked with ethyl alcohol whereby the non-exposed parts of the recording layer are removed. A selective removal of the non-exposed part of the recording layer can also be obtained by rubbing the exposed layer with a cotton pad soaked with benzene.

Preparation of polyethylene latex

In a metal 400 ccs pressure tube are placed:

| | |
|---|---|
| a partly oxidized polyethylene prepared according to U.K. Patent Specification No. 997,135 filed October 25, 1953 by W.R. Grace & Co., by the oxidation of polyethylene (average molecular weight: 7000 crystalline melting point : 125-130° C acid number : 26–30) | 40 g |
| n-hexadecyloxy-decaoxyethylene | 13.4 g |
| water | 150 ccs |

EXAMPLE 13

A poly(ethylene terephthalate) support of 0.1 mm thickness provided with a subbing layer for gelatin is coated with the following solution pro rata of 50 g/sq.m.:

| | | |
|---|---|---|
| 10 % | aqueous gelatin | 935 g |
| 10 % | aqueous saponin | 30 g |
| 3 % | aqueous solution of the sodium salt of the condensation product of oleic acid and methyltaurine | 30 g |
| 4 % | aqueous formaldehyde | 5 g |

After solidifying, a heat-sensitive layer is applied thereto from the following composition pro rata of 36 g/sq.m.:

| | | |
|---|---|---|
| 10 % | aqueous gelatin | 100 g |
| 40 % | aqueous dispersion of polyethylene having a particle size of less than 0.1 $\mu$ and an average molecular weight comprised between 15,000 and 30,000 | 160 g |
| | aqueous carbon dispersion containing pro 100 g 53 g of carbon, 23 g of water, 18 g of glycol and 6 g of nonyl phenyl polyethylene oxide | 8 g |
| 5 % | aqueous solution of sodium tetra-decyl sulphate | 80 g |
| 4 % | aqueous formaldehyde | 5 g |

-continued

| | |
|---|---|
| water | 640 g |

After drying, the heat-sensitive copying material is contact-exposed through a negative transparency. The exposure is carried out by means of a xenon gas discharge lamp placed at a distance of 4 cm of the recording material and having a capacity of 800 Watt. sec. producing light in a time of $3 \times 10^{-4}$ sec. Without any further treatment the exposed material can be used as a planographic printing plate on a conventional offset press, by using an ink having an oily or greasy base and by keeping the plate wet with water during printing.

EXAMPLE 14

To a cellulose triacetate support provided with a subbing layer for gelatin a first layer is applied from the following composition pro rata of 30 g/sq.m.

| | | |
|---|---|---|
| 10 % | aqueous gelatin | 300 g |
| | water | 170 g |
| 10 % | aqueous saponin | 30 g |
| 3 % | aqueous solution of the sodium salt of the condensation product of oleic acid and methyltaurine | 20 g |

After solidifying, a second layer is applied thereto from the following composition pro rata of 30 g/sq.m.

| | | |
|---|---|---|
| 10 % | aqueous gelatin | 50 g |
| | water | 350 g |
| 40 % | aqueous dispersion of polyethylene having a particle size of less than 0.1 $\mu$ and an average molecular weight comprised between 15,000 and 30,000 | 80 g |
| | aqueous carbon dispersion containing per 100 g 53 g of carbon, 23 g of water 18 g of glycol and 6 g of nonyl phenyl polyethylene oxide | 4 g |
| 5 % | aqueous solution of sodium tetradecyl sulphate | 40 g |

Figure 13:
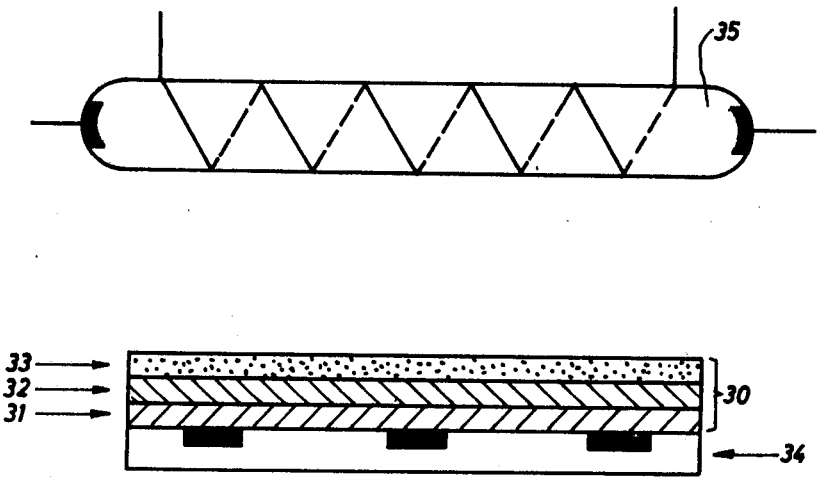

After being exposed as schematically illustrated in FIG. 13 the material is dipped into a 5% solution of potassium thiocyanate at room temperature and then with its heat-sensitive layer pressed against a receiving paper. The material and the receiving paper are led between two pressure rollers at a travelling speed of about 10 cm/sec. On emerging from between the rollers, both materials are immediatedly peeled apart. A part of the heat-sensitive and the gelatin layer is transferred image-wise to the receiving paper. The transferred image still being wet, the receiving paper is pressed against the dyestuff layer of a spirit-duplicating sheet carrying no hydrophobic surface layer. After a contact time of about 1 min. both layers are separated. At the areas corresponding with the transferred image part of the dyestuff layer has been transferred so that a dyestuff-containing laterally reversed image of the original is obtained. The material thus obtained can be used as a spirit-duplicating master.

EXAMPLE 15

A poly(ethylene terephthalate) support of 0.1 mm thickness is coated with the following composition pro rata of 70 g/sq.m.

| | |
|---|---|
| polyhexamethylene adipate | 20 g |
| polyisobutylene (average molecular weight 10,000) | 4 g |
| methylene chloride | 200 g |

When dried, a second layer is coated onto the former one from the following composition pro rata of 35 g/sq.m. :

| | | |
|---|---|---|
| 40 % | aqueous dispersion of polyethylene as described in example 14 | 100 g |
| | water | 600 g |
| | aqueous carbon dispersion as described in example 14 | 5 g |
| 5 % | aqueous dispersion of sodium tetradecyl sulphate | 25 g |

The material is exposed as described in example 11. With its heat-sensitive layer in contact with a receiving paper, it is then led through a thermoplastic copying machine "Eichner" at setting 2, the receiving paper facing the I.R. source. "Eichner" is a trade name of Eichner Dry Copy, Frankfurt on Main, W. Germany, for a thermographic copying machine. A legible print in accordance with the orginal is formed on the receiving paper.

When the exposure is done as described in example in example 14, a laterally reversed image of the original is obtained. When this laterally reversed image is heated to 100° C and dusted with a magnetised iron powder, the powder adheres to the transferred image parts, so that after cooling to room temperature a magnetic printing plate is obtained.

EXAMPLE 16

To a transparent paper support of 50 g/sq.m., coated with a polyethylene layer of 15 g/sq.m. and which has been treated with a corona discharge, a layer is applied from the following composition pro rata of 36 g/sq.m. :

| | | |
|---|---|---|
| 10 % | aqueous solution of gelatin | 900 ccs |
| 10 % | aqueous solution of saponin | 30 ccs |
| 5 % | aqueous solution of the condensation product of oleic acid and methyltaurine | 30 ccs |

After drying, a second layer is applied thereto in a proportion of 36 g/sq.m. from the following composition:

| | | |
|---|---|---|
| 10 % | aqueous solution of gelatin | 50 ccs |
| 40 % | aqueous dispersion of polyethylene | 80 ccs |
| 53 % | aqueous dispersion of carbon black | 4 ccs |
| | water | 1000 ccs |

After drying, the material obtained is exposed and processed as described in example 3. After peeling apart both materials, a dry legible copy of the original is obtained on the receiving paper.

We claim:

1. Process for producing an original having visible light absorptive image markings on a light transparent background by exposing to visible light a heat-sensitive recording layer, which method comprises the steps of imagewise exposing said recording layer to light passing through said original while said original is disposed between said recording layer to light passing through said original while said original is disposed between said recording layer and the source of said light in heat-conductive relation to said recording layer, said recording layer consisting essentially of a hydrophilic water-removable binder having homogeneously distributed therethrough finely divided particles of a hydrophobic thermoplastic polymer normally solid at room temperature and finely divided material capable of absorbing visible light and converting such absorbed light into heat, said layer being generally transparent in the absence of said material, said exposure being for a time lasting no longer than $10^{-1}$ second to visible light of an intensity of at least 0.3 Watt, second per sq. cm. and sufficient to heat the areas of said layer corresponding to the transparent areas of the original to reduce the water removability thereof not sufficient to heat the areas of said layer corresponding to the image areas of said original to reduce the water removability thereof; and washing said exposed layer with an aqueous liquid to remove therefrom the areas corresponding to said image areas said finely divided light absorbing material being selected from the group consisting of carbon black, graphite, a heavy metal, or an oxide or sulfide of such heavy metal.

2. A method for recording respectively reproducing information according to claim 1, wherein the exposure is carried out by means of visible light.

3. A method for recording respectively reproducing information according to claim 1, wherein the layer is exposed for less than $10^{-2}$ second.

4. A method for recording respectively reproducing information according to claim 1, wherein said substance absorb visible light of the whole visible spectrum or of a part thereof.

5. A method according to claim 3, wherein the exposure time is comprised between $10^{-2}$ and $10^{-4}$ seconds.

6. A method for recording respectively reproducing information according to claim 1, wherein said sheet or layer is prepared starting from an aqueus dispersion of said thermoplastic polymer particles and said particles are used in a ratio greater than 3:2 by weight in respect of the hydrophilic binder. is a water-permeable colloid.

7. A method for recording respectively reproducing information according to claim 1, wherein the hydrophilic binder is a water-permeable colloid.

8. A method for recording respectively reproducing information according to claim 7, wherein the hydrophilic binder is a water-soluble colloid.

9. A method for recording respectively reproducing information according to claim 8, wherein the said colloid is soluble in water at room temperature.

10. A method for recording respectively reproducing information according to claim 8, wherein the hydrophilic binder is gelatin.

11. A method for recording respectively reproducing information according to claim 9, wherein the said colloid is poly(N-vinylpyrrolidone).

12. A method for recording respectively reproducing information according to claim 1, wherein the said hydrophobic polymer particles soften between 10° and 200° C above room temperature.

13. A method for recording respectively reproducing information according to claim 1, wherein said polymer particles size from 0.1 $\mu$ to 50 $\mu$.

14. A method for recording respectively reproducing information according to claim 1, wherein the recording layer contains a wetting agent for the hydrophobic polymer.

* * * * *

UNITED STATES PATENT AND TRADEMARK OFFICE

CERTIFICATE OF CORRECTION

PATENT NO. : 4,004,924

DATED : January 25, 1977

INVENTOR(S) : Marcel Nicolas Vrancken et al

It is certified that error appears in the above–identified patent and that said Letters Patent are hereby corrected as shown below:

In the Claims:

Claim 1, lines 7 through 9, "to light passing through said original while said original is disposed between said recording layer" should be deleted since the passage has been printed twice.

Claim 6, last line, "is a water-permeable colloid." should be deleted.

Signed and Sealed this

Nineteenth Day of April 1977

[SEAL]

*Attest:*

RUTH C. MASON
*Attesting Officer*

C. MARSHALL DANN
*Commissioner of Patents and Trademarks*